US006502245B1

(12) United States Patent
McBride

(10) Patent No.: US 6,502,245 B1
(45) Date of Patent: Jan. 7, 2003

(54) FABRIC COVERED ELASTIC SWEATBAND

(76) Inventor: Craig A. McBride, 850 18th St., Manhattan Beach, CA (US) 90266

( * ) Notice: Subject to any disclaimer, the term of this patent is extended or adjusted under 35 U.S.C. 154(b) by 0 days.

(21) Appl. No.: 09/460,598

(22) Filed: Dec. 14, 1999

(51) Int. Cl.[7] ..... A42B 1/22
(52) U.S. Cl. ..... 2/181; 2/DIG. 11
(58) Field of Search ..... 2/171, 170, 181, 2/181.2, DIG. 11; 206/80 J

(56) References Cited

U.S. PATENT DOCUMENTS

| | | | | | |
|---|---|---|---|---|---|
| 2,052,123 | A | | 8/1936 | Adamson | 2/195 |
| 2,544,798 | A | * | 3/1951 | Lippman | 2/181 |
| 4,394,782 | A | * | 7/1983 | Wasson | 2/181 |
| 4,833,734 | A | * | 5/1989 | Der Estephian | 2/171 |
| 5,377,360 | A | * | 1/1995 | Fleitman | 2/181 |
| 5,488,740 | A | | 2/1996 | Garza | 2/175.1 |
| 5,615,415 | A | | 4/1997 | Beckerman | 2/195.3 |
| 5,632,046 | A | | 5/1997 | Green et al. | 2/183 |
| 5,715,540 | A | | 2/1998 | Cho | 2/195.3 |
| 5,822,799 | A | | 10/1998 | Kepple | 2/183 |
| 5,915,534 | A | | 6/1999 | May | 2/181.4 |
| 5,920,909 | A | * | 7/1999 | Ellsworth | 2/171 |
| 5,926,850 | A | | 7/1999 | Han | 2/183 |
| 5,930,842 | A | * | 8/1999 | Burruss | 2/452 |
| 5,963,989 | A | * | 10/1999 | Robertson | 2/411 |
| 5,966,742 | A | | 10/1999 | Cunliffe | 2/195.3 |

* cited by examiner

*Primary Examiner*—Bibhu Mohanty
(74) *Attorney, Agent, or Firm*—Lyon & Lyon LLP

(57) ABSTRACT

A self-adjusting fabric covered sweatband designed to fit in any type of headwear to achieve a one size fits all situation. The sweatband is completely elastic all the way through its circumference and is covered by a fabric material to absorb the sweat.

14 Claims, 2 Drawing Sheets

FABRIC COVERED ELASTIC SWEATBAND

BACKGROUND OF THE INVENTION

1. Field of the Invention

This invention relates generally to sweatbands used in conjunction with hats and/or other head coverings and more particularly to adjustable sweatbands in which an elastic material is used so that a hat or other head covering can be worn by persons of different head sizes.

2. Background

Because people have differing head sizes, head coverings, including caps, hats, and/or visors, have been pre-sized in a variety of different sizes. In addition, these head coverings have also been created with a size adjustment such that one size can fit any size head. While pre-sized hats provide an ideal custom fit for individual wearers, there is a high cost for manufacturers and retailers having to maintain an inventory of caps in all available sizes. Thus, an adjustable cap is preferred in terms of reducing costs for the manufacturer and the retailer.

The most widely known size adjustment consists of a pair of plastic straps in the back of a cap. The cap has a semicircular open area forming a gap at the back. The straps are attached at opposite ends of the gap. One strap has a plurality of holes, and a second strap has a plurality of snaps designed to engage the holes of the first strap. Another type of adjustment means consists of a hook and loop fastener. Both of these adjustment means have the disadvantage of aesthetics in that the back of the hat has an opening where the straps or hook and loop fasteners are located. In addition, the wearer is required to find the correct fit by trial and error.

One way to have an adjustable cap and overcome these problems is to utilize an elastic band that can accommodate different head sizes. There are caps available wherein elastic bands go either throughout the rear portion of the hat or throughout the whole band of the hat. However, none of these caps contain an elastic band going around the complete circumference of the hat wherein the elastic band is covered by a fabric designed for the absorption of sweat. Thus, such an elastic fabric covered sweatband is desirable for use in a cap or other head covering.

SUMMARY OF THE INVENTION

The present invention addresses the problems and disadvantages of the prior art by a sweatband comprised of an elastic band covered by a fabric material. The sweatband can be used with caps, hats, visors or any other head covering. The sweatband is designed to be installed in, among other things, a self-adjusting cap, which is aesthetically appealing. The sweatband is further designed to absorb sweat from all portions of the wearer's head, which is an improvement over prior sweatbands. In addition, the fabric covering the elastic enhances the wearer's comfort when compared to a simple elastic or partially fabric covered sweatband.

In accordance with the purpose of the invention, as embodied and broadly described herein, the invention comprises a sweatband including elastic that is covered by fabric. In a preferred embodiment, the sweatband is designed to be utilized in headwear to make one size fit all wearers, as well as absorb sweat.

BRIEF DESCRIPTION OF THE DRAWINGS

The accompanying drawings, which are incorporated in and constitute part of the specification, illustrate one embodiment of the invention and together with the description serve to explain the principles of the invention.

DETAILED DESCRIPTION OF THE PREFERRED EMBODIMENTS

Reference will now be made in detail to the presently preferred embodiments of the invention, an example of which is illustrated in the accompanying drawings. Whenever possible, the same reference numbers will be used throughout the drawings to refer to the same or like parts.

Figure 1:
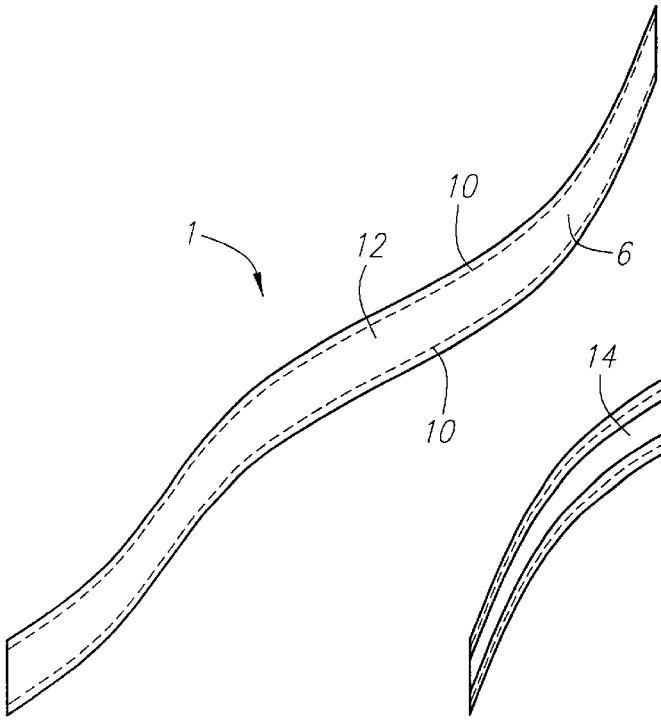
FIG. 1 depicts the front of the extended sweatband covered with fabric.
Figure 2:
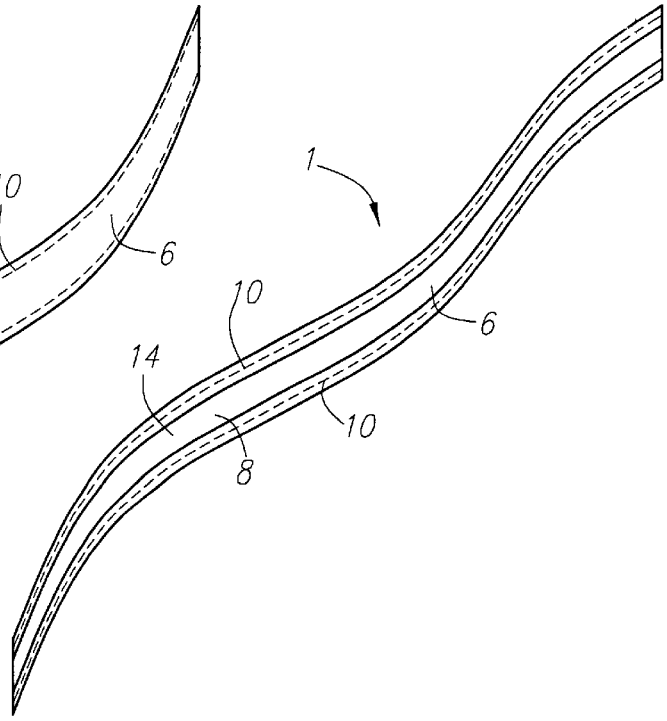
FIG. 2 depicts the back side of the extended sweatband, which illustrates the two seams where the fabric has been sewn to the elastic.
Figure 3:
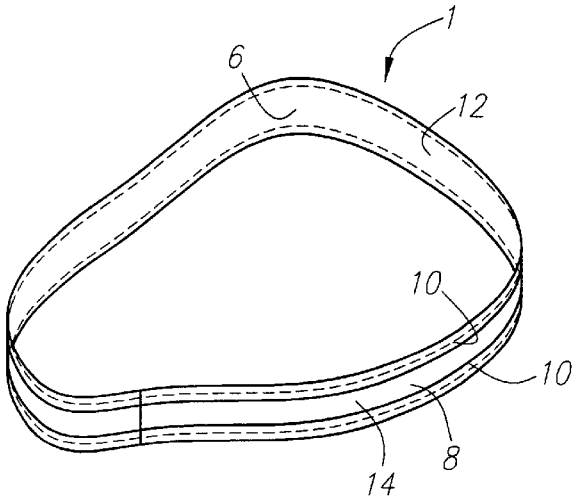
FIG. 3 depicts an oblique view of the complete sweatband, which is sewn together in its circular, band form.

As shown in FIGS. 1–3, a sweatband 1 of the present invention comprises a strip of elastic material 8, which is stretchable lengthwise in a uniaxial direction. Elastic material 8 is covered by fabric 6. Fabric 6 preferably fully covers the front surface 12 of the sweatband 1.

The fabric is attached to the elastic 8 via two seams of thread 10. The front surface 12 of the sweatband 1 is preferably designed to abut the wearer, while the back surface 14 is designed to face away from the wearer. In a preferred embodiment, there is an open elastic space in the back surface 14 of the sweatband 1 between where the seams 10 attach the fabric 6 to the elastic 8.

Elastic material 8, which is stretchable lengthwise in a uniaxial direction, may be of any suitable composition. Preferably, there are two components to elastic 8. Further preferably, the first component consists of polyester, cotton, or nylon, with the first component ranging from about 20% to about 95% of the total elastic mixture. Preferably, the second component consists of one of the following four components: latex, lycra, neoprene or spandex, with the second component ranging from about 5% to about 80% of the total elastic mixture.

Figure 5:
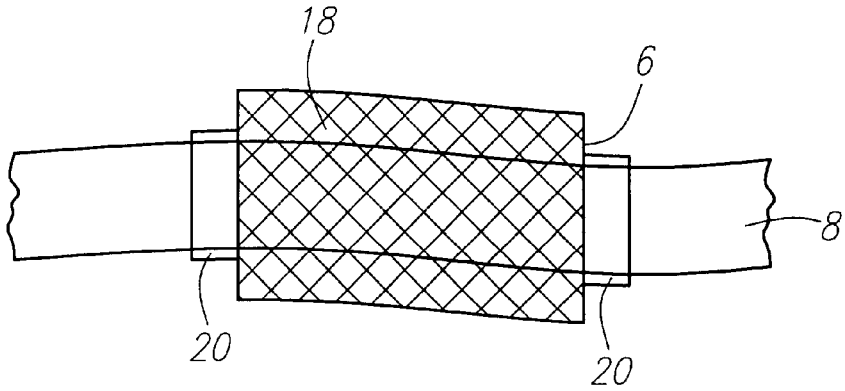
FIG. 5 depicts the orientation of the threads of the fabric of the sweatband in one embodiment of the invention and a water-repellant lining.

Fabric 6, which covers elastic 8, is preferably designed to stretch along with the elastic 8. In a preferred embodiment of the invention, the fabric is designed to stretch because it has been cut so that the threads of fabric 6 are oriented at a 45 degree angle to the long axis of sweatband 1, as shown in FIG. 5, which permits elongation of fabric 6 to conform to the shape of the elastic 8. Alternatively, stretchable fabrics could also be cut vertically, horizontally or at any other angle and still achieve the same result of allowing the fabric to conform to the shape of the elastic.

One preferred fabric 6 that can be utilized consists of about 83% acrylic, 15% wool and 2% spandex. This fabric can be either in a ribbed twill or a smooth sheeting texture. Another preferred fabric 6 consists of about 83% polyester, 15% wool, and 2% spandex. This fabric can also be used in either a ribbed twill or sheeting form. Other preferred fabrics which can be used in either twill or sheeting form include: (1) approximately 7 to 12 ounce 100% cotton twill or sheeting; (2) about 98% cotton blended with about 2% spandex in either twill or sheeting; (3) about 96% cotton blended with about 4% spandex; (4) approximately 100% polyester; (5) approximately 100% stretchable polyester; (6) approximately 100% acrylic; and (7) approximately 100% stretchable acrylic. Other fabrics that absorb sweat could also be used.

In a preferred embodiment of the invention, a water-repellant lining 20 made of a plastic or other similar material fits between the fabric and the elastic to keep sweat off of the elastic.

Figure 4:
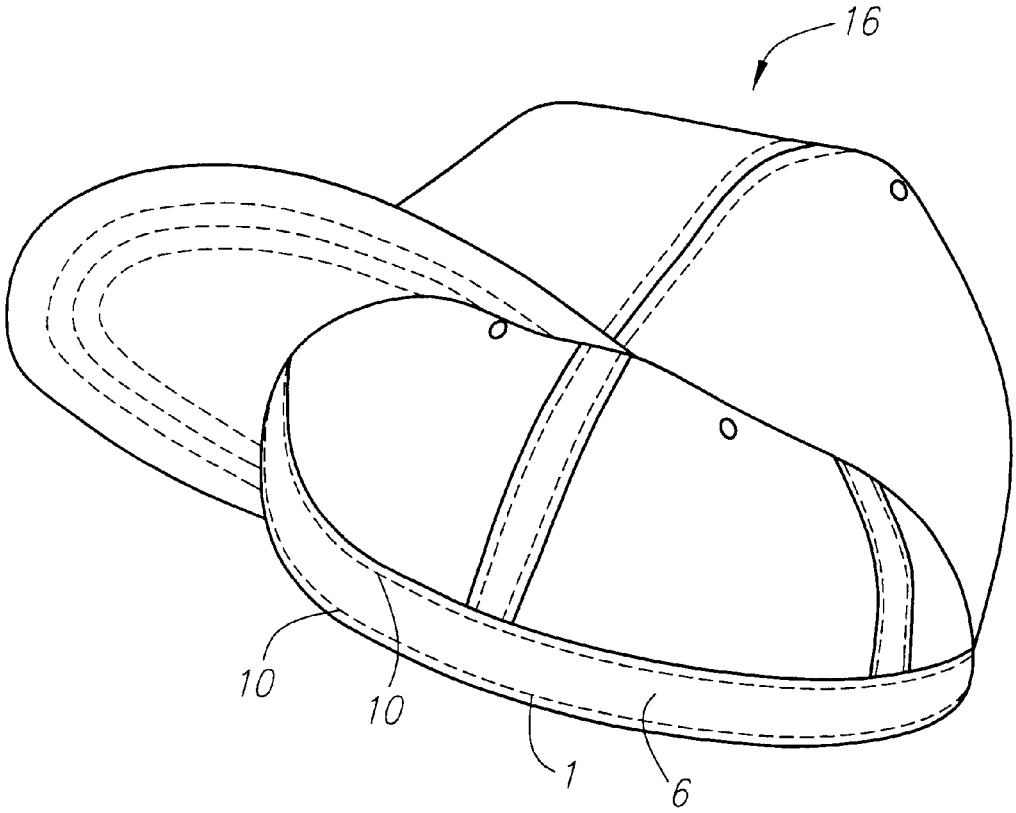
FIG. 4 depicts the sweatband as it would appear in a baseball cap.

Sweatband 1 of the present invention is preferably designed to be sewn into a hat 16, such as the baseball cap appearing in FIG. 4. In such attachment to a baseball cap, the lowermost seam is attached to the hat 10, as well as the fabric 6 of the sweatband.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A self-adjusting sweatband-comprising:

an elastic band having two flat sides;

a cloth fabric wrapped around the elastic band, wherein the cloth fabric is made of a material that stretches, wherein the cloth fabric is made of a material that absorbs sweat and wherein the cloth fabric is cut so that the threads thereof are oriented at an angle of 45° from the lengthwise direction.

2. The sweatband of claim 1 wherein the elastic band is stretchable uniaxially in a lengthwise direction.

3. The sweatband of claim 1 wherein the elastic is composed of approximately 20% to 95% of material selected from the group of polyester, cotton, and nylon, and approximately 80% to 5% of material selected from the group of lycra, neoprene and spandex.

4. The sweatband of claim 1 wherein the cloth fabric covering the elastic is composed of approximately 83% acrylic, 15% wool and 2% spandex.

5. The sweatband of claim 1 wherein the cloth fabric covering the elastic is composed of approximately 83% polyester, 15% wool and 2% spandex.

6. The sweatband of claim 1 wherein the cloth fabric wrapped around the elastic is composed of approximately 98% cotton blended with about 2% spandex.

7. The sweatband of claim 1 wherein the cloth fabric covering the elastic is composed of approximately 96% cotton blended with about 4% spandex.

8. The sweatband of claim 1 wherein the cloth fabric is cut so that the threads thereof are oriented at an angle of 45° from the lengthwise direction.

9. The sweatband of claim 1 wherein the cloth fabric is attached to the elastic band by stitching and covers one flat side of the sweatband and only part of the other flat side.

10. The sweatband of claim 1 wherein the elastic band is sized to fit within a baseball type cap.

11. The sweatband of claim 1 wherein the elastic band is sized to fit a human head and is attached to a visor.

12. The sweatband of claim 1 wherein the elastic is sized to fit within a hat.

13. The sweatband of claim 1 further comprising:

a water-repellent lining between the elastic band and the cloth fabric.

14. The sweatband of claim 13 wherein the elastic band is stretchable uniaxially in a lengthwise direction.

* * * * *